US008535117B2

(12) United States Patent
Nakanishi et al.

(10) Patent No.: US 8,535,117 B2
(45) Date of Patent: Sep. 17, 2013

(54) METHOD AND APPARATUS FOR POLISHING A SUBSTRATE HAVING A GRINDED BACK SURFACE

(75) Inventors: Masayuki Nakanishi, Tokyo (JP); Masunobu Onozawa, Tokyo (JP); Masaya Seki, Tokyo (JP)

(73) Assignee: Ebara Corporation, Tokyo (JP)

( * ) Notice: Subject to any disclaimer, the term of this patent is extended or adjusted under 35 U.S.C. 154(b) by 408 days.

(21) Appl. No.: 12/956,381

(22) Filed: Nov. 30, 2010

(65) Prior Publication Data

US 2011/0136411 A1 Jun. 9, 2011

(30) Foreign Application Priority Data

Dec. 3, 2009 (JP) ..... 2009-275408

(51) Int. Cl.
*B24B 1/00* (2006.01)

(52) U.S. Cl.
USPC ..... 451/41; 451/44; 451/59; 451/168; 451/303; 451/307

(58) Field of Classification Search
USPC ..... 451/41, 43, 44, 59, 168, 303, 310, 451/307, 6, 173, 398, 388
See application file for complete search history.

(56) References Cited

U.S. PATENT DOCUMENTS

| | | | | |
|---|---|---|---|---|
| 5,624,760 | A * | 4/1997 | Collins et al. | 428/426 |
| 6,302,769 | B1 * | 10/2001 | Nishi et al. | 451/44 |
| 6,402,596 | B1 * | 6/2002 | Hakomori et al. | 451/44 |
| 6,422,930 | B2 * | 7/2002 | Hakomori | 451/325 |
| 6,475,293 | B1 * | 11/2002 | Moinpour et al. | 134/6 |
| 6,558,239 | B2 * | 5/2003 | Kunisawa et al. | 451/303 |
| 6,629,875 | B2 * | 10/2003 | Steere, III | 451/9 |
| 6,685,539 | B1 * | 2/2004 | Enomoto et al. | 451/41 |
| 7,014,536 | B2 * | 3/2006 | Sakai | 451/41 |
| 7,118,449 | B1 * | 10/2006 | Dinger et al. | 451/6 |
| 7,367,873 | B2 * | 5/2008 | Ishii et al. | 451/168 |
| 7,744,445 | B2 * | 6/2010 | Kubota et al. | 451/41 |
| 7,862,402 | B2 * | 1/2011 | Hongo et al. | 451/5 |
| 8,047,896 | B2 * | 11/2011 | Takahashi et al. | 451/6 |
| 8,142,260 | B2 * | 3/2012 | Kollata et al. | 451/44 |
| 8,152,598 | B2 * | 4/2012 | Fukushima et al. | 451/11 |
| 8,187,055 | B2 * | 5/2012 | Takahashi et al. | 451/9 |
| 2001/0011002 | A1 * | 8/2001 | Steere, III | 451/168 |
| 2001/0014570 | A1 * | 8/2001 | Wenski et al. | 451/41 |
| 2005/0250296 | A1 * | 11/2005 | Yamamura et al. | 438/460 |
| 2009/0124174 | A1 * | 5/2009 | Fukushima et al. | 451/44 |
| 2009/0142992 | A1 | 6/2009 | Takahashi et al. | |

FOREIGN PATENT DOCUMENTS

| | | |
|---|---|---|
| JP | 04-085827 | 3/1992 |
| JP | 04-263425 | 9/1992 |
| JP | 08-107092 | 4/1996 |
| JP | 08-107193 | 4/1996 |
| JP | 11-333680 | 12/1999 |
| JP | 2000-173961 | 6/2000 |
| JP | 2000-315783 | 11/2000 |
| JP | 2005-019435 | 1/2005 |

* cited by examiner

*Primary Examiner* — George Nguyen
(74) *Attorney, Agent, or Firm* — Wenderoth, Lind & Ponack, L.L.P.

(57) ABSTRACT

A method capable of quickly polishing an angular portion formed by a grinded back surface and a circumferential surface of a substrate without causing damages on the thin substrate is provided. The method includes rotating the substrate about its center, and pressing a polishing tape against the angular portion formed by the back surface and the circumferential surface of the substrate to polish the angular portion.

11 Claims, 20 Drawing Sheets

METHOD AND APPARATUS FOR POLISHING A SUBSTRATE HAVING A GRINDED BACK SURFACE

BACKGROUND OF THE INVENTION

1. Field of the Invention

The present invention relates to a method and an apparatus for polishing a substrate after a back surface of the substrate is grinded, and more particularly to a method and an apparatus for polishing an angular portion formed by the grinded back surface and a circumferential surface of the substrate.

2. Description of the Related Art

In fabrication processes of SOI (Silicon on Insulator) substrate, through-silicon via (TSV), power device (i.e., semiconductor element for electric power), and the like, a back surface of a substrate is grinded for making the substrate thinner. In this grinding process, a grinding tool, which is called a back grinder, is used. The back surface of the substrate is grinded until a thickness of the substrate is reduced to, for example, 300 μm or less. Specifically, the back surface of the substrate is pressed against the rotating back grinder, so that the back surface of the substrate is grinded until the thickness of the substrate reaches a desired thickness.

Generally, a circumferential surface of the substrate is polished in advance in a rounded shape in order to prevent cracking or chipping thereof. When the back surface of the substrate having such a circumferential surface with a rounded shape is grinded, an angular edge is formed on the substrate as a result of the grinding. FIG. 1 shows an example of an acute angular edge as a result of a process of grinding the back surface until the thickness of the substrate is reduced to half or less. This angular edge (which will be hereinafter referred to as angular portion) is constituted by the grinded back surface and the circumferential surface of the substrate. Such acute angular portion is likely to be chipped by a physical contact, and the substrate itself may be broken during transportation of the substrate. Particularly, in the nature of the substrate, once the substrate is chipped, the crack tends to extend into a region where devices are formed, thus causing defects of products. Further, the angular portion may hinder uniform grinding of the back surface, and may even cause cracking of the substrate during grinding.

Thus, in order to prevent such damages of the substrate, it has been customary to remove the angular portion formed on the substrate by bringing a grinding stone (or a lapping tool) into contact with the substrate. More specifically, the substrate is held by a support stage by a vacuum suction or the like with its grinded surface facing upward, and the substrate is rotated about its center. In this state, the grinding stone is brought into contact with the angular portion of the substrate to thereby polish the angular portion.

However, the substrate is not perfectly round and moreover it is difficult to strictly align the center of the substrate with a rotational axis of the support stage. Therefore, when the grinding stone contacts the angular portion of the substrate, the grinding stone may damage the substrate. In order to prevent such damage to the substrate, it is necessary to bring the grinding stone closer to the substrate slowly. However, this results in a longer time for bringing the grinding stone into contact with the substrate (this time is referred to as "air-cutting time"), thus lowering throughput. Moreover, even after the grinding stone contacts the substrate, it is necessary to move the grinding stone very slowly until the angular portion in its entirety is removed by the grinding stone.

Consequently, a long grinding time is needed for softening an impact between the grinding stone, which is a rigid body, and the substrate.

Generally, a protection film is attached to the substrate whose back surface is grinded, as shown in FIG. 2. This protection film is for the purpose of protecting devices formed on a front surface (i.e., a surface opposite to the back surface) of the substrate. The protection film is attached so as to cover the front surface and the circumferential surface of the substrate. Polishing of the angular portion of the substrate with the protection film attached is performed basically in the same manner as described above. Specifically, the front surface of the substrate with the protection film attached thereto is held by the support stage, and the angular portion of the substrate, rotated by the support stage, is polished by the grinding stone. The grinding stone polishes the angular portion while grinding the protection film.

However, if an adhesive, which is used for the protection film, exists unevenly in a circumferential direction of the substrate, the protection film may locally hinder polishing of the substrate. As a result, the substrate is unevenly polished. Further, the adhesive may be attached to the grinding stone, thus lowering the polishing performance of the grinding stone.

SUMMARY OF THE INVENTION

The present invention has been made in view of the above drawbacks. It is therefore an object of the present invention to provide a method and an apparatus capable of quickly polishing an angular portion formed by a grinded back surface and a circumferential surface of a substrate without causing damages to the thin substrate having the grinded back surface.

In order to achieve the above object, according to one aspect of the present invention, there is provided a method of polishing a substrate having a grinded back surface. The method includes: rotating the substrate about its center; and pressing a polishing tape against an angular portion formed by the back surface and a circumferential surface of the substrate to polish the angular portion.

In a preferred aspect of the present invention, the pressing of the polishing tape against the angular portion to polish the angular portion is performed while changing an angle of contact between the substrate and the polishing tape.

In a preferred aspect of the present invention, a protection film is attached to a front surface and the circumferential surface of the substrate, and the pressing of the polishing tape against the angular portion to polish the angular portion is performed while peeling the protection film from the substrate by sending the polishing tape from a back-surface side to a front-surface side of the substrate.

In a preferred aspect of the present invention, a protection film is attached to a front surface and the circumferential surface of the substrate, and the pressing of the polishing tape against the angular portion to polish the angular portion is performed while peeling the protection film from the substrate by continuously changing an angle of a polishing head that presses the polishing tape against the substrate.

In a preferred aspect of the present invention, the substrate has an orientation flat. The method further includes: after polishing the angular portion, rotating the substrate until the orientation flat faces the polishing tape; polishing the orientation flat by causing the polishing tape to oscillate laterally while pressing the polishing tape against the orientation flat; after polishing the orientation flat, rotating the substrate until a boundary portion between the orientation flat and the circumferential surface faces the polishing tape; and polishing the boundary portion by causing the polishing tape to oscillate laterally while pressing the polishing tape against the boundary portion.

In a preferred aspect of the present invention, the substrate has an orientation flat. The method further includes causing the orientation flat to face a cutout cover having a shape corresponding to the orientation flat. The polishing of the angular portion is performed while rotating the substrate and the cutout cover together about the center of the substrate.

In a preferred aspect of the present invention, during polishing of the angular portion, the polishing tape contacts the angular portion and the cutout cover.

In a preferred aspect of the present invention, the cutout cover is configured to be unlikely to be polished.

In a preferred aspect of the present invention, the polishing tape polishes the cutout cover and the angular portion during polishing of the angular portion.

Another aspect of the present invention provides an apparatus for polishing a substrate having a grinded back surface. The apparatus includes: a rotary holding mechanism configured to rotate the substrate about its center, the rotary holding mechanism including a cutout cover having a shape corresponding to an orientation flat of the substrate; and a polishing head configured to press a polishing tape against an angular portion formed by the back surface and a circumferential surface of the substrate so as to polish the angular portion.

According to the present invention, because the polishing tape has flexibility, the angular portion is not cracked by the contact with the polishing tape. Therefore, the polishing tape can approach the substrate quickly, and the air-cutting time can be shortened. Further, even if the protection film is attached to the front surface of the substrate, the polishing tape can polish the angular portion of the substrate while peeling the protection film from the substrate. Therefore, uniform polishing can be achieved without being affected by the protection film.

DETAILED DESCRIPTION OF THE PREFERRED EMBODIMENTS

Embodiments of the present invention will be described below with reference to the drawings.

An object to be polished by a polishing method of the present invention is a thin substrate used in fabrication processes of SOI (Silicon on Insulator) substrate, through-silicon via (TSV), and power device (i.e., semiconductor element for electric power). This thin substrate has a back surface that has been grinded by a grinding tool (e.g., a back grinder). The SOI substrate is a substrate having an insulating layer of $SiO_2$ and a silicon single crystal layer formed on the insulating layer. The through-silicon via (TSV) is an electrode extending vertically through a semiconductor chip. The power device is an element that converts electric power into another form of electric power or an element that controls electric power. Typical examples of the power device include power transistor, thyristor, and rectifier diode.

Figure 1:
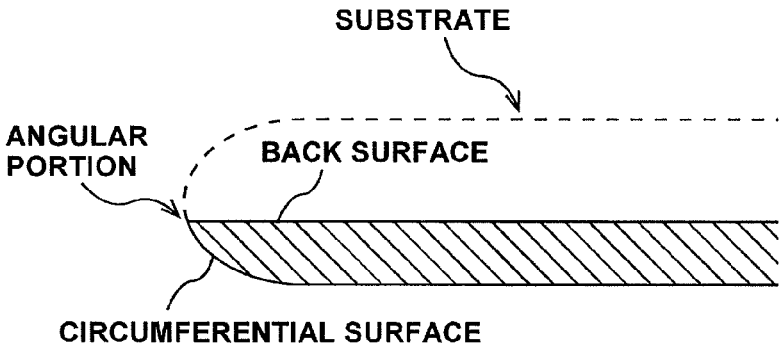
FIG. 1 is a cross-sectional view showing a substrate having a grinded back surface.
Figure 2:
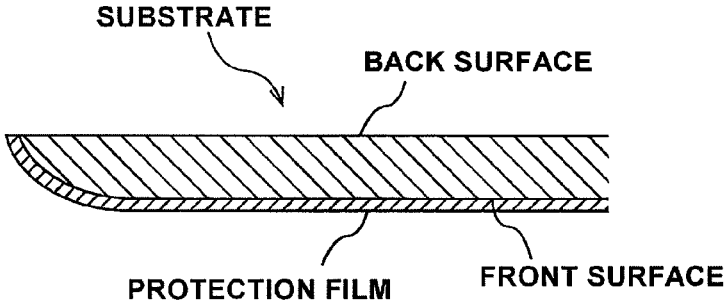
FIG. 2 is a cross-sectional view showing a substrate with a protection film attached thereto.

The object to be polished according to the polishing method of this embodiment is the SOI substrate or the substrate having the through-silicon via (TSV) or the power device formed therein, which is a thin substrate whose back surface is grinded. One example of the substrate to be polished is a substrate comprising a wafer (e.g., a silicon wafer or a wafer made of compound semiconductor) and the power device formed on a surface of the wafer, and a back surface of this substrate is grinded until a thickness thereof is reduced to half or less of its original thickness. Such a substrate has, as shown in FIG. 1, an angular portion formed by the grinded back surface and a circumferential surface of the substrate. Generally, a protection film is attached to a front surface (i.e., a surface opposite to the back surface) of the substrate in order to protect devices formed on the front surface. The polishing method, which will be described below, can be applied to both of a substrate with the protection film attached thereto and a substrate with no protection film.

Figure 3:
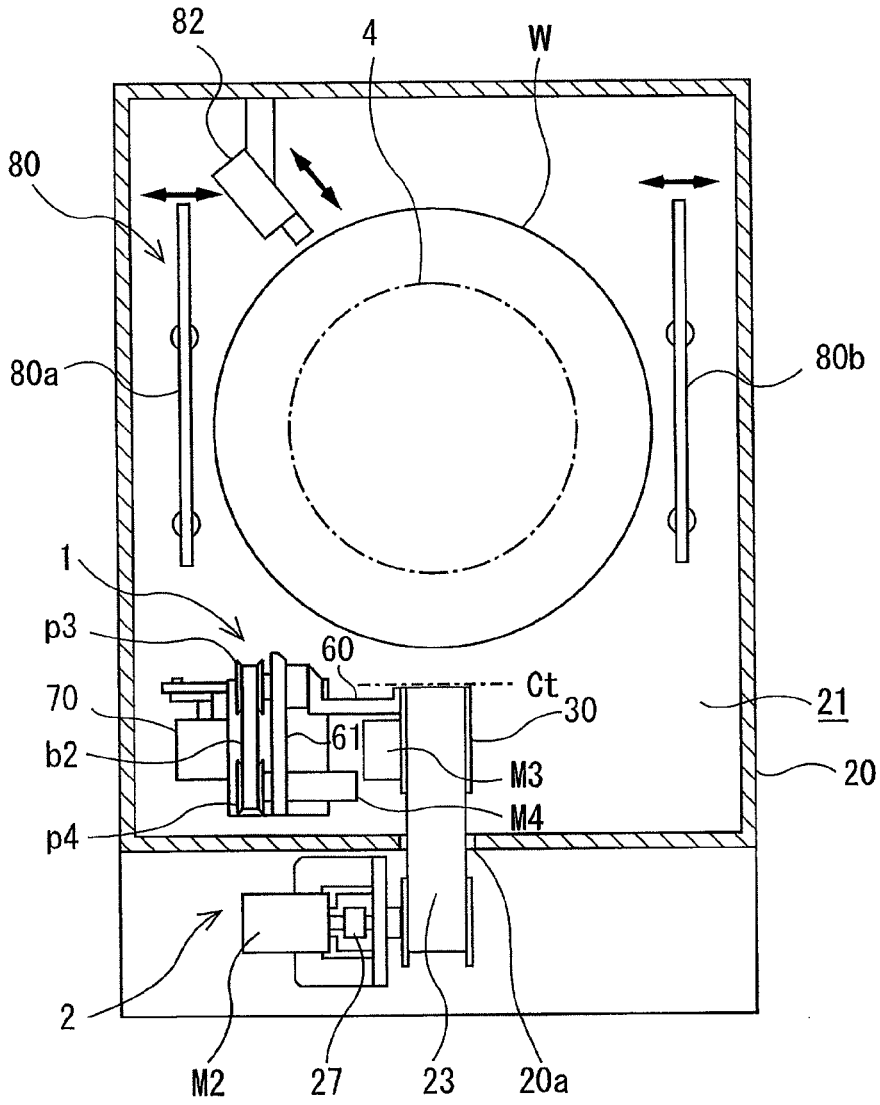
FIG. 3 is a plan view showing a polishing apparatus for performing a polishing method according to an embodiment of the present invention.
Figure 4:
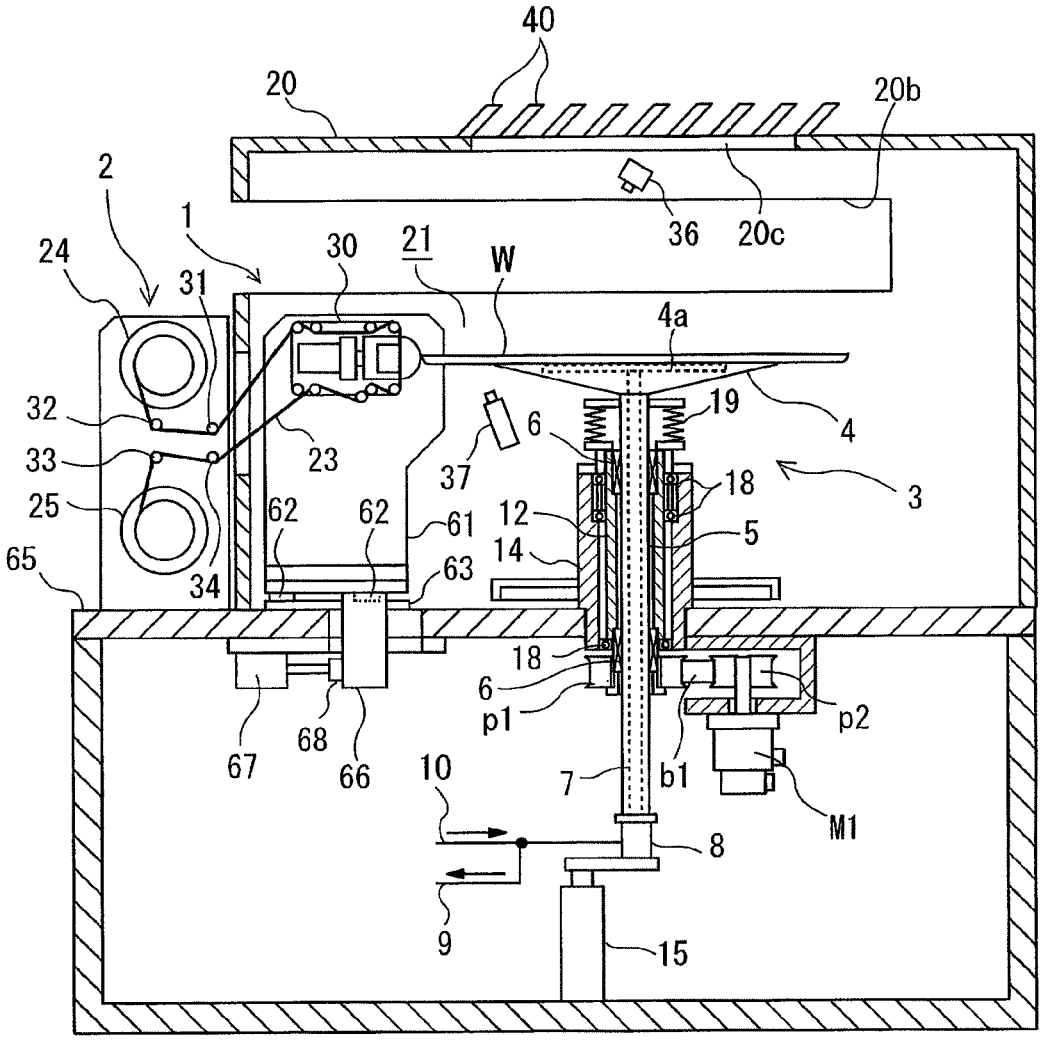
FIG. 4 is a vertically cross-sectional view of the polishing apparatus shown in FIG. 3.

FIG. 3 is a plan view showing a polishing apparatus for carrying out the polishing method according to the embodiment of the present invention. FIG. 4 is a vertical cross-sectional view of the polishing apparatus shown in FIG. 3. The polishing apparatus is a device for polishing and removing the angular portion (see FIG. 1) of the substrate. As shown in FIG. 3 and FIG. 4, the polishing apparatus includes a rotary holding mechanism 3 configured to hold a substrate W (i.e., a workpiece to be polished) horizontally and to rotate the substrate W about its central axis. The rotary holding mechanism 3 is located in the center of the polishing apparatus. FIG. 3 and FIG. 4 show a state in which the rotary holding mechanism 3 holds the substrate W. This rotary holding mechanism 3 has a holding stage 4 configured to hold the substrate W by a vacuum suction, a hollow shaft 5 coupled to a central portion of the holding stage 4, and a motor M1 for rotating the hollow shaft 5.

The hollow shaft 5 is supported by two ball spline bearings (linear motion bearings) 6 which allow the hollow shaft 5 to move vertically. The holding stage 4 has an upper surface having grooves 4*a*. These grooves 4*a* communicate with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing a processed substrate W from the holding stage 4. By selectively coupling the vacuum line 9 and the nitrogen-gas supply line 10 to the communication passage 7, the substrate W can be held on the upper surface of the holding stage 4 by the vacuum suction and can be released from the upper surface of the holding stage 4.

A pulley p1 is fixed to one of the two ball spline bearings 6. A pulley p2 is mounted on a rotational shaft of the motor M1. The hollow shaft 5 is rotated by the motor M1 through the pulley p1, the pulley p2, and a belt b1 riding on these pulleys p1 and p2. With these structures, the substrate W, held on the upper surface of the holding stage 4, is rotated by the motor M1.

The ball spline bearing 6 allows the hollow shaft 5 to move freely in its longitudinal direction. The ball spline bearings 6 are secured to an inner circumferential surface of a cylindrical casing 12. A cylindrical casing 14 is provided so as to surround the casing 12. Radial bearings 18 are provided between the casing 12 and the casing 14, so that the casing 12 is rotatably supported by the radial bearings 18. The hollow shaft 5 can move linearly up and down relative to the casing 12, and the hollow shaft 5 and the casing 12 can rotate in unison. The hollow shaft 5 is coupled to an air cylinder (elevating mechanism) 15, so that the hollow shaft 5 and the holding stage 4 are elevated and lowered by the air cylinder 15. With these structures, the rotary holding mechanism 3 can rotate the substrate W about its central axis and can elevate and lower the substrate W along the central axis.

As shown in FIG. 3, a polishing head assembly (polishing section) 1 is disposed close to the substrate W held by the rotary holding mechanism 3. A tape supply mechanism 2 is provided radially outwardly of the polishing head assembly 1. The polishing head assembly 1 is isolated from the tape supply mechanism 2 by a partition 20. An interior space of the partition 20 provides a polishing room 21. The polishing head assembly 1 and the holding stage 4 are located in the polishing room 21. On the other hand, the tape supply mechanism 2 is located outside the partition 20 (i.e., outside the polishing room 21).

The polishing tape supply mechanism 2 includes a supply reel 24 for supplying a polishing tape (i.e., a polishing tool) 23 to the polishing head assembly 1, and a recovery reel 25 for recovering the polishing tape 23 that has been used in polishing of the substrate W. The supply reel 24 is arranged above the recovery reel 25. Motors M2 are coupled respectively to the supply reel 24 and the recovery reel 25 via couplings 27 (FIG. 3 shows only the coupling 27 and the motor M2 coupled to the supply reel 24). Each of the motors M2 is configured to exert a constant torque in a predetermined rotational direction so as to apply a predetermined tension to the polishing tape 23.

The polishing tape 23 is a long tape-shaped polishing tool, and one of surfaces thereof provides a polishing surface. The polishing tape 23 is wound on the supply reel 24, which is mounted on the tape supply mechanism 2. One end of the polishing tape 23 is attached to the recovery reel 25, so that the recovery reel 25 collects the polishing tape 23 supplied to the polishing head assembly 1 to thereby recover the polishing tape 23. The polishing head assembly 1 has a polishing head 30 for pressing the polishing tape 23, supplied from the tape supply mechanism 2, against the substrate W. The polishing tape 23 is supplied to the polishing head 30 such that the polishing surface of the polishing tape 23 faces the substrate W.

The tape supply mechanism 2 has plural guide rollers 31, 32, 33, and 34. The polishing tape 23, to be supplied to and recovered from the polishing head assembly 1, is guided by these guide rollers 31, 32, 33, and 34. The polishing tape 23 is supplied to the polishing head 30 from the supply reel 24 of the tape supply mechanism 2 through an opening 20*a* formed in the partition 20, and the polishing tape 23 used in polishing of the substrate is recovered by the recovery reel 25 through the opening 20*a*.

As shown in FIG. 4, a polishing liquid supply nozzle 36 is provided above the substrate W. This polishing liquid supply nozzle 36 is configured to supply a polishing liquid onto an upper surface (i.e., the back surface) of the substrate W held by the rotary holding mechanism 3. Further, a polishing liquid supply nozzle 37 is provided for supplying a polishing liquid onto a boundary between the substrate W and the holding stage 4 (i.e., onto a periphery of the holding stage 4). Typically, pure water is used as the polishing liquid.

In order to isolate the ball spline bearings 6 and the radial bearings 18 from the polishing room 21 when the hollow shaft 5 is elevated and lowered relative to the casing 12, the hollow shaft 5 and an upper end of the casing 12 are coupled to each other by a bellows 19 that is extendible and contractible in a vertical direction, as shown in FIG. 4. FIG. 4 shows a state in which the hollow shaft 5 is in a lowered position and the holding stage 4 is in a polishing position. After the polishing process, the air cylinder 15 elevates the substrate W, together with the holding stage 4 and the hollow shaft 5, to a transport position, where the substrate W is released from the holding stage 4.

The substrate W is transported into and removed from the polishing room 21 by hands (not shown) of the transporting mechanism. The partition 20 has an entrance 20*b* through which the substrate W is transported into and removed from the polishing room 21. The entrance 20*b* is in a shape of horizontally extending cutout. Therefore, the substrate W, held by the transporting mechanism, can travel horizontally across the polishing room 21 through the entrance 20*b*. As shown in FIG. 3, a centering chuck 80 for receiving the substrate W from the transporting mechanism is provided in the polishing room 21. This centering chuck 80 has a pair of chucking arms 80*a* and 80*b* which are arranged so as to sandwich the substrate W. The chucking arms 80*a* and 80*b* are configured to hold the substrate W such that the center of the substrate W and the center of the holding stage 4 coincide with each other.

An upper surface of the partition 20 has an aperture 20*c* and louvers 40, and a lower surface of the partition 20 has a gas-discharge opening (not shown in the drawing). During the polishing process, the entrance 20*b* is closed by a non-illustrated shutter. Therefore, as a fan mechanism (not shown in the drawing) is driven to evacuate an air in the polishing room 21 through the gas-discharge opening, downward flow of a clean air is formed in the polishing room 21. Because the polishing process is performed under such conditions, the polishing liquid is prevented from scattering upwardly. Therefore, the polishing process can be performed while keeping an upper space of the polishing room 21 clean.

Figure 5:
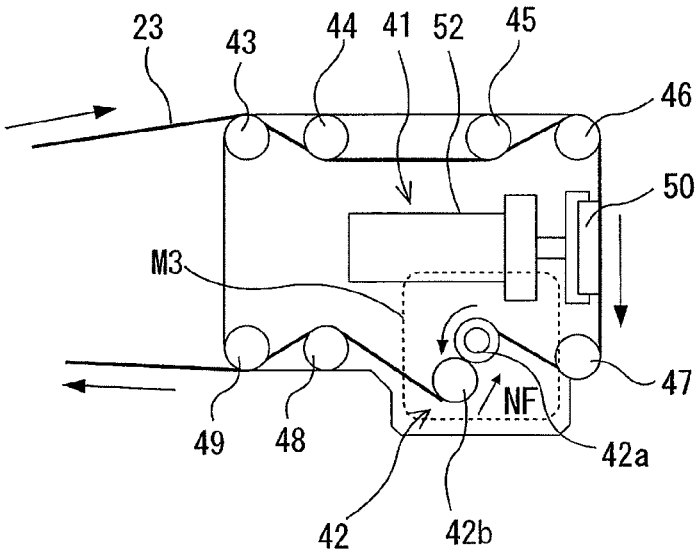
FIG. 5 is an enlarged view of a polishing head.

FIG. 5 is an enlarged view of the polishing head 30. As shown in FIG. 5, the polishing head 30 has a pressing mechanism 41 configured to press the polishing tape 23 against the substrate W at a predetermined force. The pressing mechanism 41 is located at a rear side of the polishing tape 23. The polishing head 30 further includes a tape-sending mechanism 42 configured to send the polishing tape 23 from the supply reel 24 to the recovery reel 25. The polishing head 30 has plural guide rollers 43, 44, 45, 46, 47, 48, and 49, which guide the polishing tape 23 such that the polishing tape 23 travels in a direction perpendicular to a tangential direction of the substrate W.

The tape-sending mechanism 42 of the polishing head 30 includes a tape-sending roller 42*a*, a tape-holding roller 42*b*, and a motor M3 configured to rotate the tape-sending roller 42*a*. The motor M3 is mounted on a side surface of the polishing head 30. The tape-sending roller 42*a* is coupled to a rotational shaft of the motor M3. The tape-holding roller 42*b* is supported by a non-illustrated biasing mechanism, which biases the tape-holding roller 42*b* in a direction indicated by NF in FIG. 5 (i.e., in a direction toward the tape-sending roller 42*a*) so as to press the tape-holding roller 42*b* against the tape-sending roller 42*a*. The polishing tape 23 is interposed between the tape-sending roller 42*a* and the tape-holding roller 42*b*.

As the motor M3 rotates in a direction indicated by arrow in FIG. 5, the tape-sending roller 42*a* is rotated to move the polishing tape 23 in its longitudinal direction. The polishing tape 23 is pulled out from the supply reel 24 and sent to the recovery reel 25 via the polishing head 30. The tape-holding roller 42*b* is configured to be rotatable freely about its own axis and is rotated as the tape-sending roller 42*a* rotates.

The pressing mechanism 41 includes a press pad 50 located at the rear side of the polishing tape 23 and an air cylinder (an actuator) 52 configured to move the press pad 50 toward the substrate W. The press pad 50 is made of soft material, such as rubber or sponge. The air cylinder 52 is a so-called single rod cylinder. The load of the press pad 50 that presses the polishing tape 23 against the substrate W is regulated by controlling air pressure supplied to the air cylinder 52.

Figure 6A:
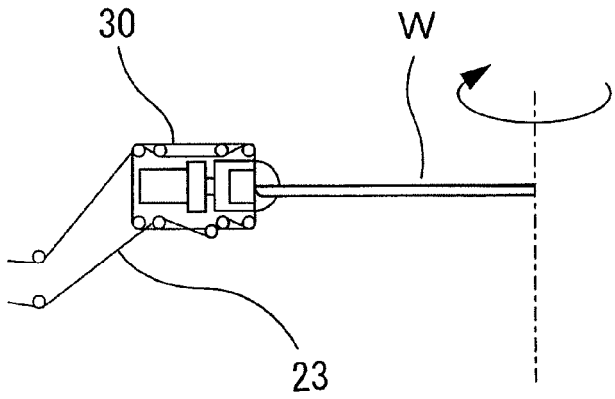
FIG. 6A through FIG. 6C are side views showing the polishing head tilted by a tilting mechanism.
Figure 6B:
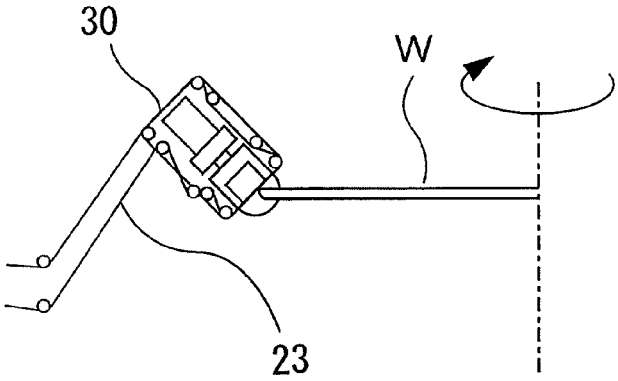
Figure 6C:
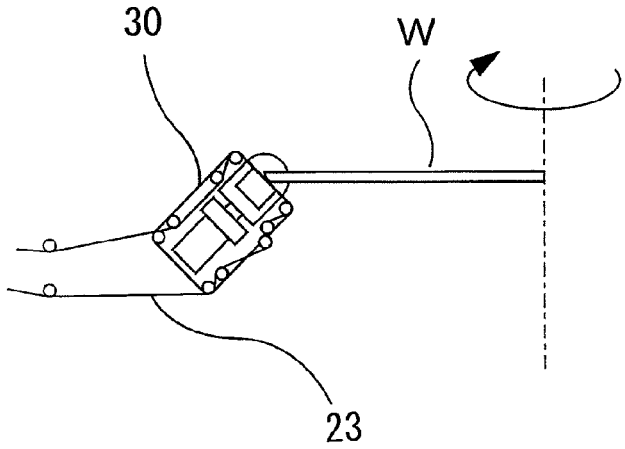

As shown in FIG. 3, the polishing head 30 is secured to one end of an arm 60, which is rotatable about an axis Ct extending parallel to the tangential direction of the substrate W. The other end of the arm 60 is coupled to a motor M4 via pulleys p3 and p4 and a belt b2. As the motor M4 rotates in a clockwise direction and a counterclockwise direction through a certain angle, the arm 60 rotates about the axis Ct through a certain angle to thereby tilt the polishing head 30. FIGS. 6A through 6C are side views showing the polishing head 30 tilted by a tilting mechanism. In this embodiment, the motor M4, the arm 60, the pulleys p3 and p4, and the belt b2 constitute the tilting mechanism for tilting the polishing head 30. The tilt motion of the polishing head 30 is performed before polishing or during polishing. This tilt motion of the polishing head 30 enables the polishing tape 23 to remove the angular portion of the substrate W and to finish the substrate W in a desired shape. In this embodiment, the tilting mechanism is configured to tilt the polishing head 30 upwardly at an angle of 100 degrees and downwardly at an angle of 90 degrees from the horizontal plane.

As shown in FIG. 4, the tilting mechanism is mounted on a movable base 61 in a plate shape. This movable base 61 is movably coupled to a base plate 65 via guides 62 and rails 63. The rails 63 extend linearly in a radial direction of the substrate W held on the rotary holding mechanism 3, so that the movable base 61 can move linearly in the radial direction of the substrate W. A connection plate 66, extending through the base plate 65, is secured to the movable base 61. A linear actuator 67 is coupled to the connection plate 66 via a joint 68. This linear actuator 67 is secured to the base plate 65 directly or indirectly.

The linear actuator 67 may comprise an air cylinder or a combination of a positioning motor and a ball screw. The linear actuator 67, the rails 63, and the guides 62 constitute a moving mechanism for linearly moving the polishing head 30 in the radial direction of the substrate W. Specifically, the moving mechanism is operable to move the polishing head 30 along the rails 63 closer to and away from the substrate W. On the other hand, the tape supply mechanism 2 is fixed to the base plate 65.

Figure 7A:
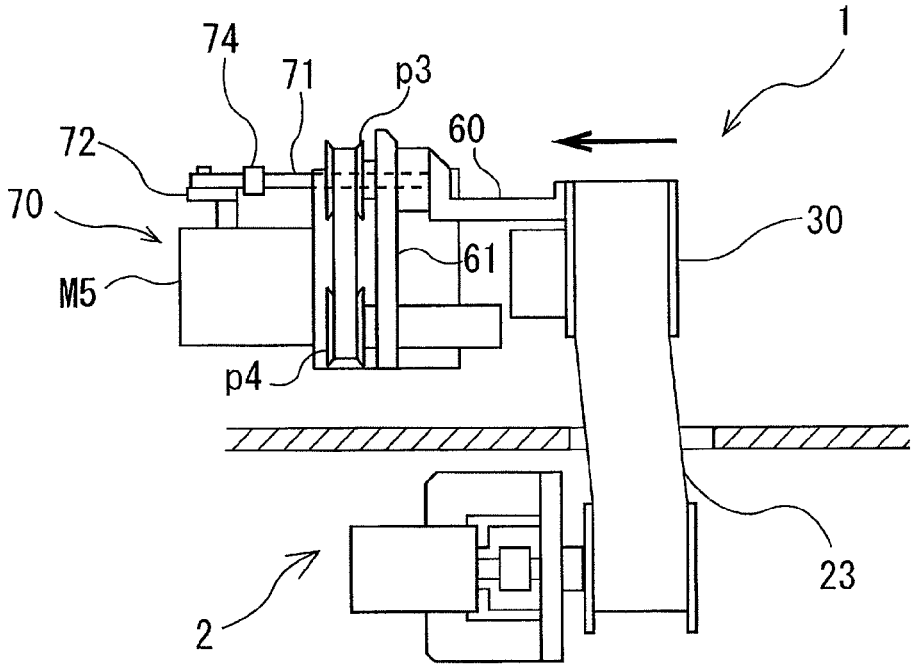
FIG. 7A and FIG. 7B are enlarged plan views of a polishing head assembly.
Figure 7B:
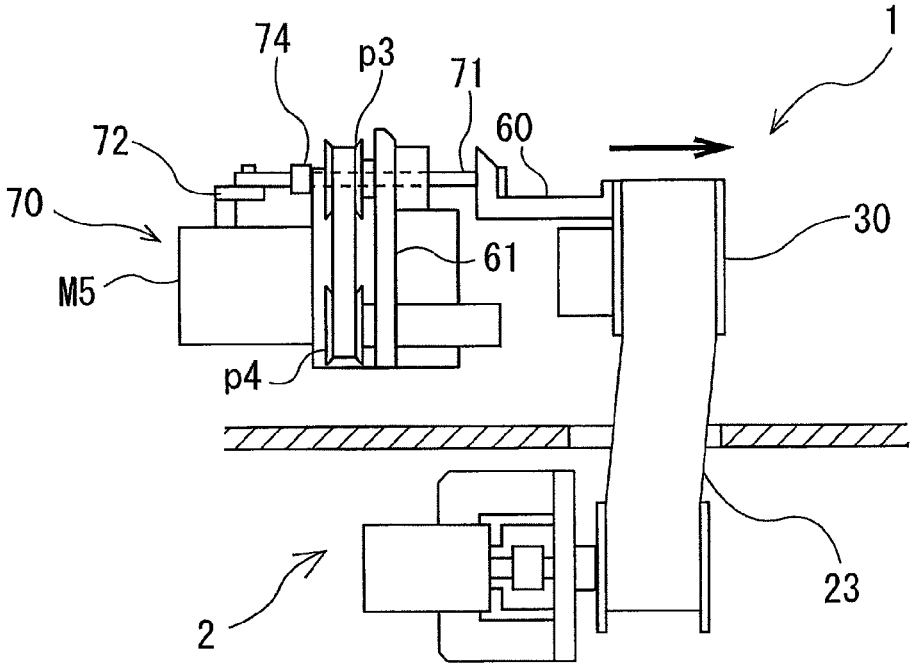

FIGS. 7A and 7B are enlarged plan views of the polishing head assembly. The polishing head assembly 1 includes an oscillation mechanism 70 for causing the polishing head 30 to oscillate in the tangential direction of the substrate W on the holding stage 4. This oscillation mechanism 70 includes an oscillation shaft 71 coupled to the end of the arm 60, a crank 72 coupled to the oscillation shaft 71, and a motor M5 for rotating the crank 72. The oscillation shaft 71 has a spline (not shown in the drawing) on a part thereof, and the oscillation shaft 71 and the pulley p3 are coupled to each other via a linear motion bearing (not shown in the drawing). This linear motion bearing allows the oscillation shaft 71 to move linearly relative to the pulley p3 in the axial direction of the oscillation shaft 71 while allowing the oscillation shaft 71 and the pulley p3 to rotate in unison.

The oscillation shaft 71 is coupled to the crank 72 via a joint 74. The joint 74 does not transmit rotation of the oscillation shaft 71 to the crank 72, but transmits a lateral movement of the crank 72 to the oscillation shaft 71. With these structures, when the crank 72 is rotated by the motor M5, the oscillation shaft 71 reciprocates in a longitudinal direction thereof as shown in FIG. 7A and 7B, thereby causing the polishing head 30 to oscillate in the tangential direction of the substrate W. A width of the oscillation of the polishing head 30 is set such that the polishing tape 23 does not undulate greatly.

The polishing tape 23 has a flexible sheet base and a polishing layer formed on one surface of the sheet base. The sheet base is made of a flexible material, such as polyethylene terephthalate, polyester, or polyurethane, and has a thickness in the range of 10 μm to 100 μm. The polishing layer comprises a mixture of abrasive particles and a binder (e.g., resin) having a bonding action. The abrasive particles are held by the binder and a surface of the polishing layer provides the polishing surface for polishing the substrate W. Materials for use as the abrasive particles include diamond, SiC, silica, ceria, cubic boron nitride, alumina, and composite material thereof. In the case of using silica particles as the abrasive particles of the polishing tape 23, use of the polishing liquid is not necessary.

A soft layer, which is made of foam material (e.g., polyethylene or polyurethane), may be formed on the surface of the sheet base, and the abrasive particles may be attached to the soft layer. The polishing tape having such a structure can polish the substrate W without putting a stress on the substrate W. Further, because this polishing tape is more likely to deform than the polishing tape using the binder and contacts the substrate W over a wide area, a polishing time is reduced. Instead of the sheet base, a sheet-like foam material may be used with the abrasive particles attached thereon to constitute a polishing tape. A sheet base having irregularities formed on a surface thereof (e.g., a nonwoven fabric or a fabric with flock finish) may be used. In this case, the abrasive particles are bonded to the surface of the sheet base by the binder. In either type of polishing tape, it is necessary that the polishing tape contain substantially no metal components in order to prevent contamination of the substrate W.

Next, operations of the polishing apparatus having the above-described constructions will be described. The substrate W is transported into the polishing room 21 through the entrance 20*b* by the hands of the transporting mechanism (not shown in the drawing), with the back surface of the substrate W facing upward. The centering chuck 80 receives the substrate W from the transporting mechanism and holds the substrate W with the chucking arms 80*a* and 80*b*. After transporting the substrate W to the centering chuck 80, the hands of the transporting mechanism moves outside of the polishing room 21. Subsequently, the entrance 20*b* is closed by the shutter (not shown in the drawing). Then, the holding stage 4 of the rotary holding mechanism 3 is elevated and the vacuum line 9 is coupled to the communication passage 7, so that the holding stage 4 holds the front surface (i.e., the surface opposite to the back surface) of the substrate W by the vacuum suction. Thereafter, the chucking arms 80*a* and 80*b* move away from the substrate W, and then the holding stage 4 is lowered down to the polishing position (the position shown in FIG. 4) while holding the substrate W.

The holding stage 4 is rotated by the motor M1 in the clockwise direction, and supply of the pure water to the substrate W from the polishing liquid supply nozzles 36 and 37 is started. When the rotational speed of the substrate W and a flow rate of the pure water supplied reach predetermined values, respectively, the polishing head 30 is moved toward the substrate W by the linear actuator 67 to bring the polishing surface of the polishing tape 23 into contact with the angular portion of the substrate W. The polishing tape 23 and the substrate W are brought into sliding contact with each other, whereby the angular portion of the substrate W is polished. During polishing of the substrate W, the polishing tape 23 is moved at a predetermined speed by the tape-sending mechanism 42 (see FIG. 5). The travel direction of the polishing tape 23 contacting the angular portion of the substrate W is a direction from the back-surface side toward the front-surface side of the substrate W. In order to reduce an amount of the polishing tape 23 used, polishing of the substrate W may be performed without sending the polishing tape 23.

During polishing of the substrate W, the polishing tape 23 is pressed against the angular portion of the substrate W by the press pad 50. Alternatively, the press pad 50 may stay away from the polishing tape 23, and the polishing tape 23 may polish the angular portion of the substrate W using the tension of the polishing tape 23. The tension of the polishing tape 23 can be adjusted by the motors M2 coupled respectively to the supply reel 24 and the recovery reel 25 and/or by the linear actuator 67 that moves the polishing head 30. In this polishing method, the pure water is used as the polishing liquid. Therefore, the polishing liquid, discharged from the polishing apparatus, does not contaminate the environment.

Polishing of the substrate W is terminated when a predetermined time has elapsed or when a torque current of the motor M1, which rotates the substrate W, has reached a predetermined threshold value. After polishing is terminated, the polishing head 30 is moved away from the substrate W, and the holding stage 4 is elevated to the transport position by the air cylinder 15. In this transport position, the vacuum suction of the substrate W by the holding stage 4 is released, and the substrate W is grasped by the centering chuck 80. The holding stage 4 is lowered, the non-illustrated shutter is opened, and the hands of the transporting mechanism (not shown in the drawing) enter the polishing room 21 through the entrance 20*b*. The hands of the transporting mechanism receive the substrate W and remove the substrate W from the polishing room 21.

As shown in FIG. 1, the substrate W to be polished has the angular portion at its edge as a result of the grinding process of the back surface thereof. This angular portion is constituted by the grinded back surface and the circumferential surface of the substrate W. Since the angular portion may have an acute cross section, it is necessary to polish the angular portion with a small load so as not to chip the angular portion. Thus, when polishing the angular portion, it is preferable to bring the polishing tape 23 into contact with the substrate W with a small pressing force (for example, in the range of 1 N to 6 N). After a predetermined time has elapsed (i.e., after the angular portion is removed), it is preferable to increase the pressing force (for example, to 8 N or more) in order to increase a polishing speed. For example, in an initial stage of polishing, the angular portion of the substrate W may be polished at a small pressing force, with the press pad 50 away from the polishing tape 23, and after the above-described predetermined time has elapsed, the polishing tape 23 may be pressed against the substrate W by the press pad 50 at a large pressing force to polish the circumferential surface of the substrate W.

From the viewpoint of preventing chipping of the angular portion of the substrate W, it is preferable to rotate the substrate at a low speed (for example, in the range of 10 to 300 $min^{-1}$) when polishing the angular portion. After the above-described predetermined time has elapsed, it is preferable to increase the rotational speed of the substrate W (for example, to 400 $min^{-1}$ or more) in order to increase the polishing speed. In this manner, it is possible to prevent chipping of the angular portion by polishing the substrate W at a small pressing force and a low rotational speed during polishing of the angular portion. After the angular portion is removed, it is possible to increase the polishing speed (i.e., removal rate) by polishing the circumferential surface of the substrate W at a large pressing force and a high rotational speed.

The pressing force of the press pad 50 may be changed during polishing. For example, at the initial stage of polishing, the press pad 50 may press the polishing tape 23 against the substrate W with a small pressing force (e.g., in the range of 1 N to 6 N) to remove the angular portion, and after the above-described predetermined time has elapsed, the pressing force of the press pad 50 may be increased (for example, to 8 N or more). In this case also, from the viewpoint of preventing chipping of the angular portion, it is preferable to rotate the substrate W at a low rotational speed (for example, in the range of 10 to 300 $min^{-1}$) at the initial stage of polishing and to increase the rotational speed of the substrate W (for example, to 400 $min^{-1}$ or more) after the above-described predetermined time has elapsed.

Figure 8:
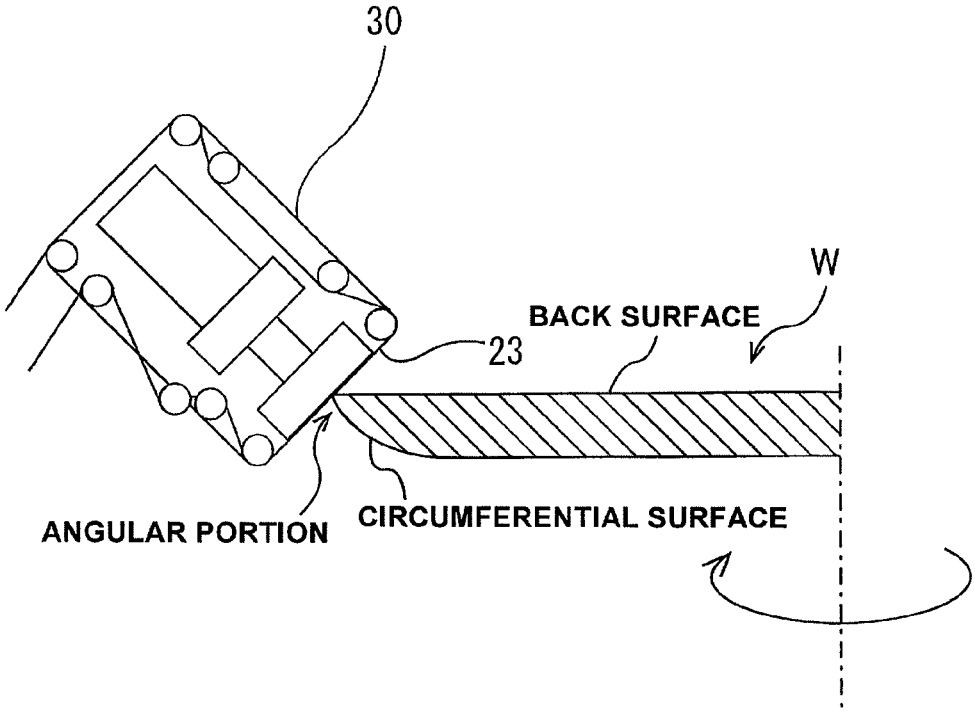
FIG. 8 is a view showing a manner in which a polishing tape is polishing an angular portion of the substrate.

A tilt angle of the polishing head 30 during polishing, i.e., an angle of contact between the polishing tape 23 and the substrate W, can be set as desired. When removing the angular portion of the substrate W, it is preferable to tilt the polishing head 30 upward (e.g., at an angle of about 45 degrees from a horizontal plane) so as to press the polishing tape 23 against the angular portion of the substrate W in an obliquely downward direction, as shown in FIG. 8. The angle of the polishing head 30 may be changed continuously within a predetermined range of angle during polishing of the angular portion. For example, the angle of the polishing head 30 may be changed from a predetermined angle α to a predetermined angle β continuously and smoothly during polishing. Further, the angle of the polishing head 30 may be changed intermittently. For example, the angle of the polishing head 30 may be changed in the order of predetermined angles α1, α2, α3, α4 at predetermined time intervals during polishing.

The circumferential surface and the angular portion of the substrate W may be polished in this order. For example, as shown in FIG. 6C, the polishing head 30 may be tilted downward with respect to the horizontal plane so as to polish the circumferential surface and the polishing head 30 may be tilted upward gradually so as to polish the angular portion. In this case also, as described previously, it is preferable to polish the angular portion with a smaller pressing force than the pressing force applied when polishing the circumferential surface. Further, as described above, it is preferable to lower the rotational speed of the substrate W when polishing the angular portion.

Figure 9A:
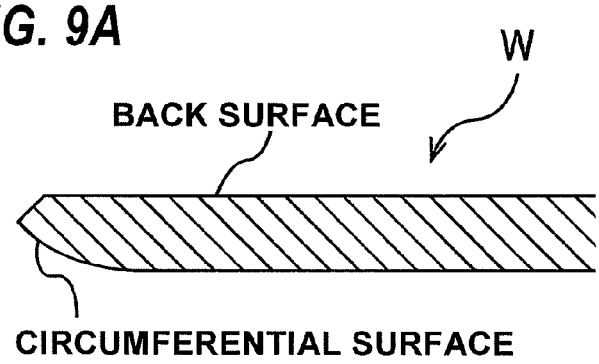
FIG. 9A and FIG. 9B are cross-sectional views showing the substrate whose angular portion is polished by the polishing tape.
Figure 9B:
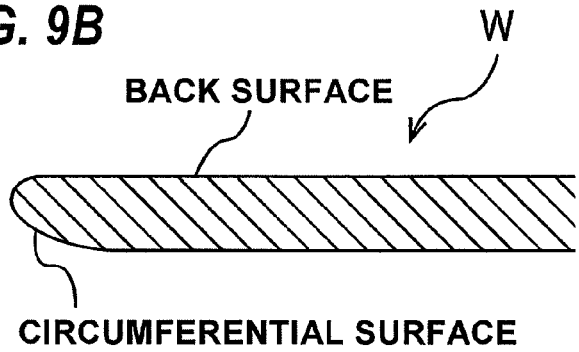

FIG. 9A is a cross-sectional view showing the substrate whose angular portion has been polished by the polishing tape 23. As shown in FIG. 9A, the angular portion, which is constituted by the back surface and the circumferential surface of the substrate W, is removed by the sliding contact between the polishing tape 23 and the substrate W. As shown in FIG. 9B, it is possible to round the circumferential surface of the substrate W, whose angular portion is removed, by tilting the polishing head 30 continuously in the predetermined range of angle during polishing of the angular portion.

Figure 10:
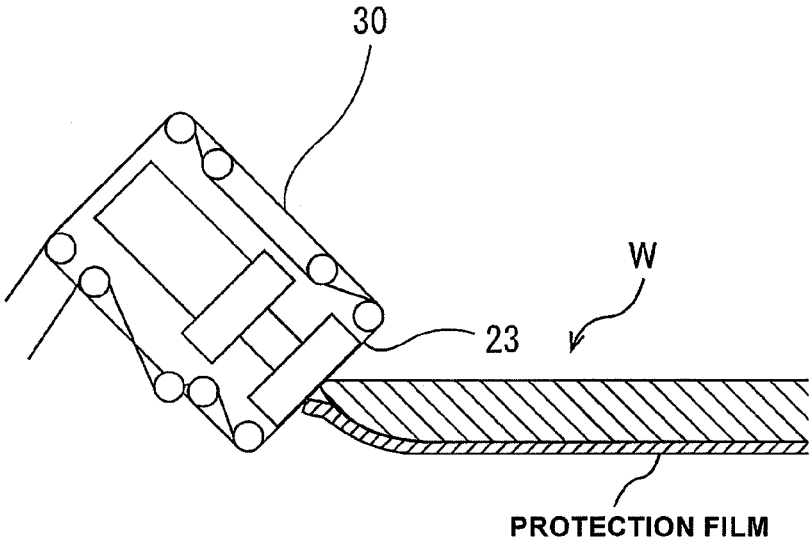
FIG. 10 is a view showing a manner in which the polishing tape is polishing the angular portion of the substrate while peeling the protection film.

As described previously, the protection film for protecting the devices may be attached to the front surface and the circumferential surface of the substrate W to be polished. This protection film typically has a thickness of about 150 μm and is attached to the substrate W with adhesive or glue. This embodiment of the polishing method using the polishing tape polishes the angular portion of the substrate W while sending the polishing tape 23 from the back-surface side to the front-surface side of the substrate W. Therefore, as shown in FIG. 10, the polishing tape 23 can polish the angular portion while peeling the protection film from the substrate W. More precisely, the polishing tape 23 peels the protection film from the substrate W and shortly after that, the polishing tape 23 polishes the angular portion. Therefore, the polishing tape 23 can polish the angular portion uniformly without being affected by the adhesive used for the protection film. The tilt motion of the polishing head 30 can also peel the protection film from the substrate W. For example, the protection film can be peeled off by tilting the polishing head 30 from an upper position to a lower position during polishing of the angular portion of the substrate W.

Figure 11A:
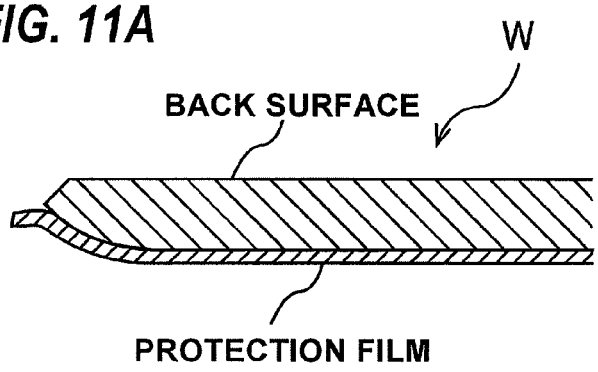
FIG. 11A and FIG. 11B are cross-sectional views showing the substrate whose angular portion is polished by the polishing tape.
Figure 11B:
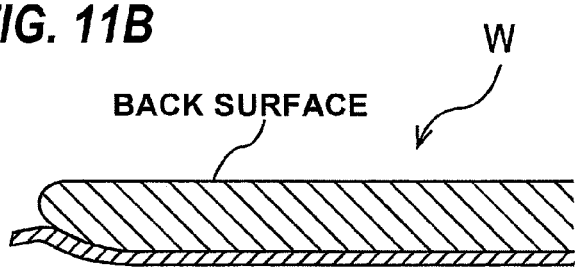

FIG. 11A is a cross-sectional view showing the substrate whose angular portion has been polished by the polishing tape 23. As shown in FIG. 11A, the angular portion, formed by the back surface and the circumferential surface of the substrate W, is removed by the sliding contact between the polishing tape 23 and the substrate W, while the movement of the polishing tape 23 and/or the tilt motion of the polishing head 30 peels the protection film from the substrate W. Further, as shown in FIG. 11B, the continuous tilt motion of the polishing head 30 in the predetermined range of angle during polishing of the angular portion can round the circumferential surface of the substrate W whose angular portion is removed.

After polishing is terminated, the holding stage 4 may rotate the substrate W at a higher rotational speed than the rotational speed during polishing of the substrate W so as to dry the substrate W. The substrate W, polished by the polishing apparatus, may be transported to a cleaning apparatus which is provided separately, and the front surface and the back surface of the substrate W may be cleaned in the cleaning apparatus. The cleaned substrate W may be further transported to a spin drying apparatus, and the substrate W may be dried by high-speed rotation of the substrate W in the spin drying apparatus. Types of the cleaning apparatus include a sponge-type cleaning apparatus configured to bring rotating sponges into contact with the front surface and the back surface of the substrate W, a fluid jet type cleaning apparatus configured to eject fluid to the front surface and the back surface of the substrate W, and a megasonic type cleaning apparatus configured to apply ultrasonic wave (vibration) to the substrate W so as to clean the substrate W.

Figure 12:
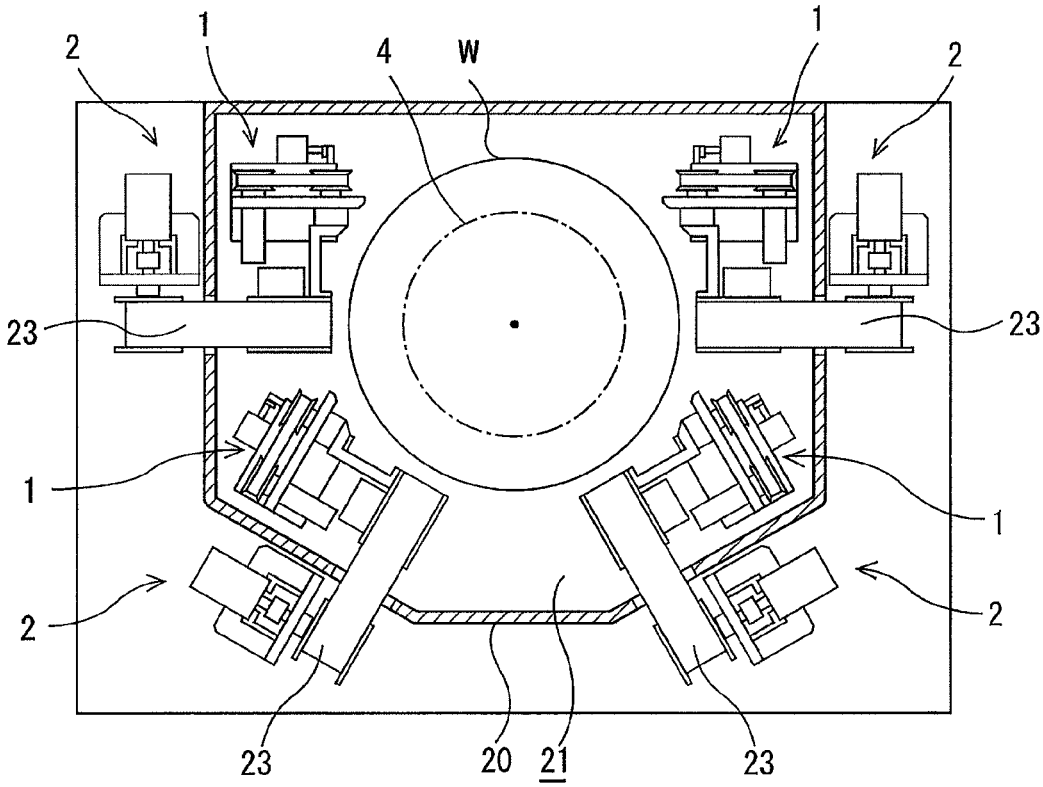
FIG. 12 is a plan view showing a polishing apparatus having multiple pairs of polishing head assemblies and polishing tape supply mechanisms.

As shown in FIG. 12, plural pairs of polishing head assemblies 1 and polishing tape supply mechanisms 2 may be provided (four pairs are illustrated in an example shown in FIG. 12). These polishing head assemblies 1 and the polishing tape supply mechanisms 2 are arranged around the substrate W held by the holding stage 4 at substantially equal intervals. The polishing apparatus shown in FIG. 12 is capable of performing multi-step polishing using different types of polishing tapes. For example, it is possible to perform rough polishing and finish polishing of the substrate W successively. The polishing apparatus according to this example can perform the multi-step polishing while keeping the substrate W on the holding stage 4. Therefore, the throughput can be improved. Further, a cleaning tape with no abrasive particles may be used in addition to the polishing tape so as to clean a portion polished by the polishing tape.

Figure 13:
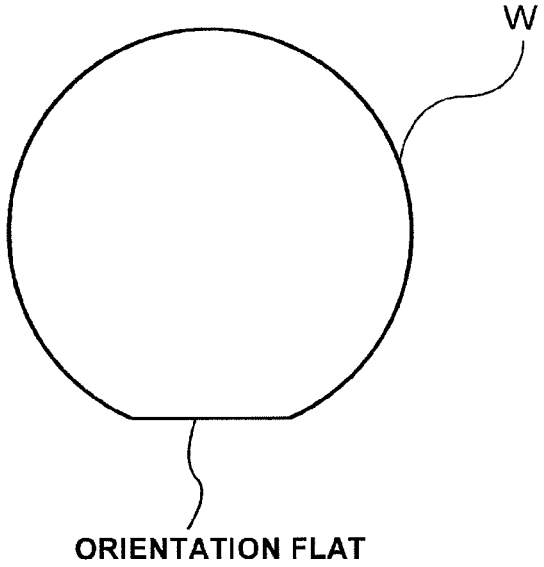
FIG. 13 is a view showing an orientation flat of the substrate.

The polishing apparatus shown in FIG. 3 and FIG. 4 can be used for polishing an orientation flat of the substrate. The orientation flat is a cutout portion formed by cutting out a part of the substrate W straightly, as shown in FIG. 13. As shown in FIG. 3, a search unit 82 for detecting the orientation flat of the substrate W is provided in the polishing room 21. This search unit 82 is configured to move between a search position and a retracted position by an actuator (not shown in the drawing). When the orientation flat is detected by the search unit 82, the substrate W is rotated by the rotary holding mechanism 3 until the orientation flat faces toward the polishing head 30.

When the substrate W is transported into the polishing room 21 through the entrance 20*b* by the transporting mechanism (not shown in the drawing), the holding stage 4 is elevated and the substrate W is held on the upper surface of the holding stage 4 by the vacuum suction. The rotary holding mechanism 3 lowers the substrate W to the polishing position. In this state, the search unit 82 detects the position of the orientation flat of the substrate W, and the rotary holding mechanism 3 rotates the substrate W until the orientation flat faces the polishing head 30. Thereafter, supply of the polishing liquid onto the substrate W from the polishing liquid supply nozzles 36 and 37 is started.

Figure 14:
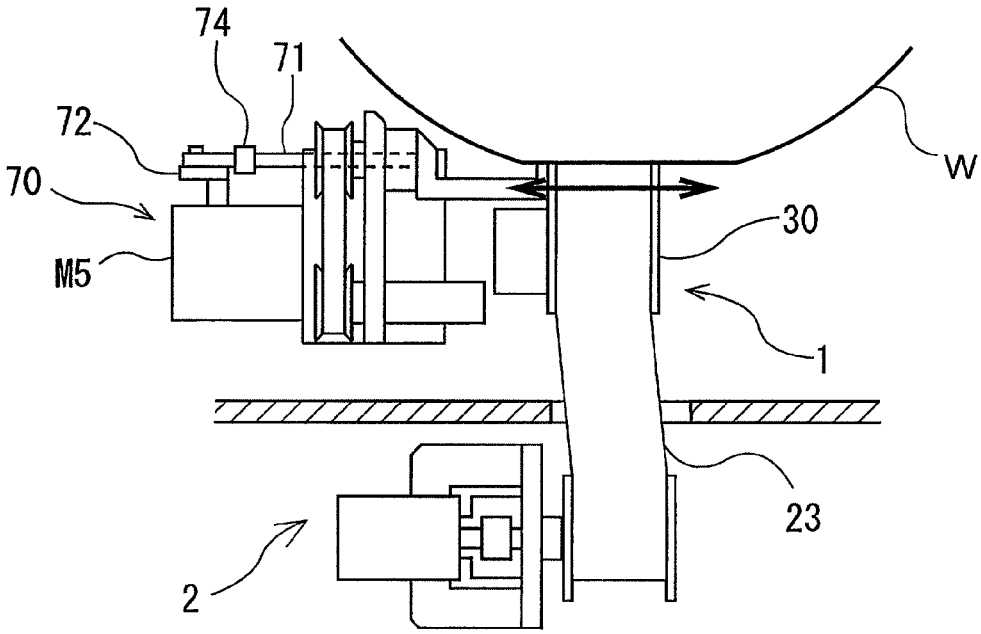
FIG. 14 is a plan view showing a manner in which the polishing tape is polishing the orientation flat.

As shown in FIG. 14, the polishing head 30 is moved toward the substrate W until it contacts the orientation flat. Then, the polishing head 30 oscillates laterally (i.e., in the tangential direction of the substrate W) by the above-described oscillation mechanism 70, with the polishing tape 23 contacting the orientation flat, to thereby polish the orientation flat. During polishing, the polishing tape 23 is moved from the back-surface side to the front-surface side of the substrate W. During polishing of the orientation flat, the polishing head 30 may be kept horizontal, or may be tilted at a predetermined angle, or may be tilted continuously in a predetermined range of angle. The rotary holding mechanism 3 does not rotate the substrate W during polishing of the orientation flat.

The polishing apparatus shown in FIG. 3 and FIG. 4 can polish the angular portion shown in FIG. 1 and the orientation flat shown in FIG. 13 successively. Polishing of the angular portion and the orientation flat is performed in the following three steps. The first polishing step is a process of polishing the angular portion of the substrate W. This first polishing step is performed while rotating the substrate W by the rotary holding mechanism 3 as described above. The second polishing step is a process of polishing the orientation flat of the substrate W (see FIG. 14). This second polishing step is performed without rotating the substrate W, as described above.

Figure 15A:
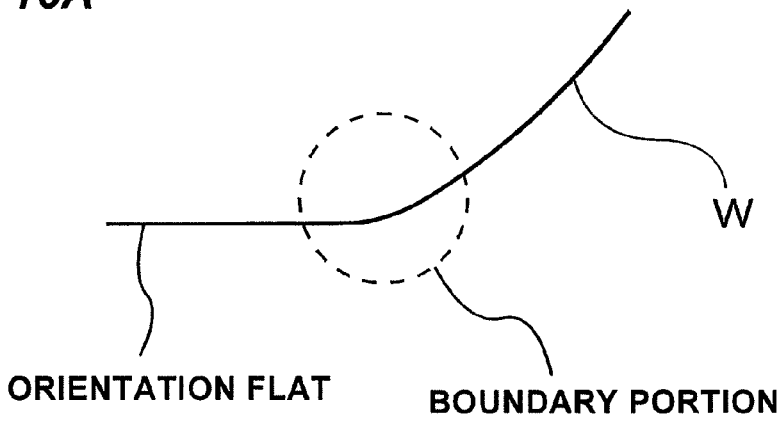
FIG. 15A and FIG. 15B are cross-sectional views showing a boundary portion between the orientation flat and the angular portion.
Figure 15B:
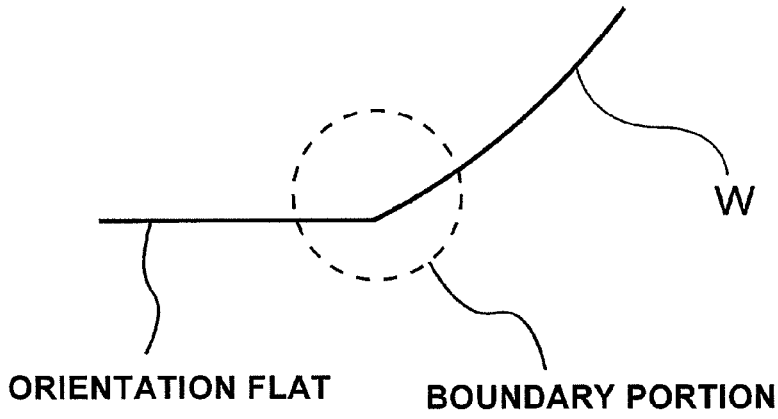

Generally, a boundary portion between the orientation flat and the circumferential surface of the substrate W has a rounded shape, as shown in FIG. 15A. However, if the orientation flat and the angular portion are polished in this order, a new angular portion is created in the boundary portion between the orientation flat and the circumferential surface due to concentration of load, as shown in FIG. 15B. In order not to create such a new angular portion, the angular portion, which is constituted by the back surface and the circumferential surface of the substrate W, is firstly polished as the first polishing step, and then the orientation flat is polished as the second polishing step. After the second polishing step, the below-described third polishing step is performed.

Figure 16:
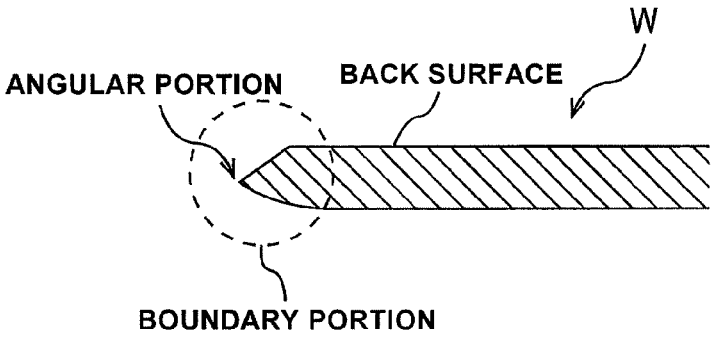
FIG. 16 is a view showing a cross section of the boundary portion between the orientation flat and the angular portion of the substrate.

The third polishing step is a process of polishing the boundary portion between the circumferential surface and the orientation flat of the substrate W. This third polishing step is performed for the following reasons. In the first polishing step for polishing the angular portion of the substrate W, the polishing head 30 is tilted upward (at an angle of about 45 degrees) such that the polishing surface of the polishing tape 23 faces obliquely downward during polishing of the angular portion of the substrate W. In this first polishing step, if the pressing force of the polishing tape 23 on the substrate W is large, a new angular portion may be formed in the boundary portion between the orientation flat and the circumferential surface of the substrate W as shown in FIG. 16, which shows a cross section of the boundary portion between the orientation flat and the circumferential surface of the substrate W. In a substrate having a normal thickness, such an angular portion formed in the boundary portion does not pose a problem. However, in the thin substrate (i.e., the substrate whose back surface has been grinded) which is an object of the polishing method, the angular portion formed in the boundary portion may be chipped. Thus, in the third polishing step, the boundary portion between the orientation flat and the circumferential surface is polished, so that the angular portion formed in the boundary portion is removed.

Figure 17:
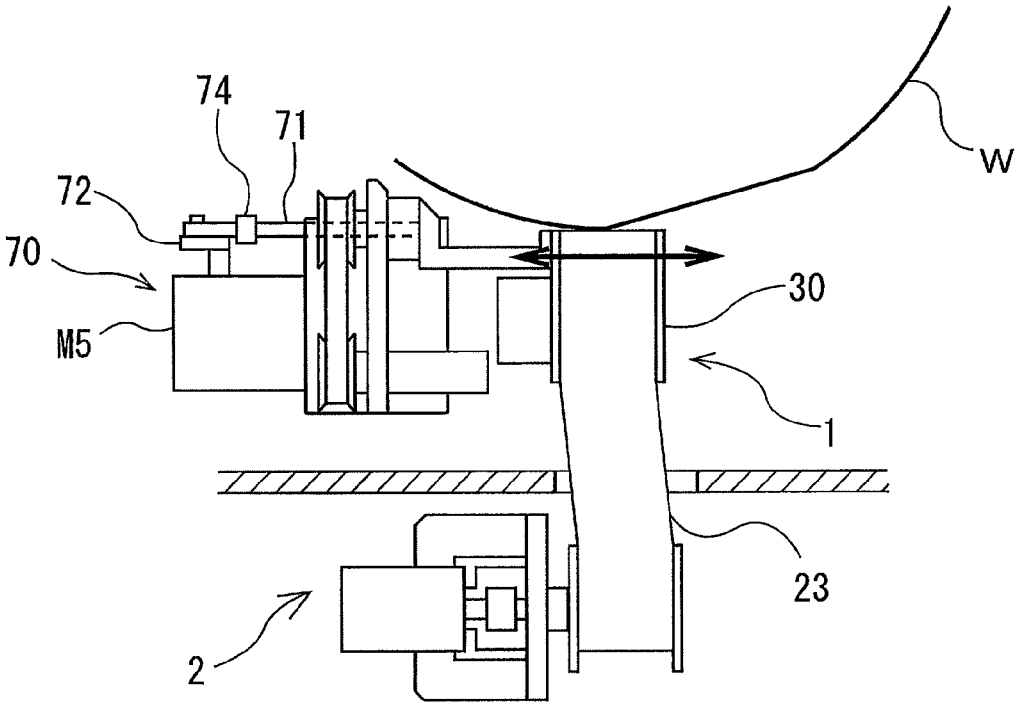
FIG. 17 is a plan view showing a manner in which the polishing tape is polishing the boundary portion between the orientation flat and the angular portion.

In the third polishing step, as shown in FIG. 17, the rotary holding mechanism 3 rotates the substrate W by a predetermined angle such that the boundary portion between the orientation flat and the circumferential surface faces the polishing surface of the polishing tape 23. In this state, the polishing head 30 is moved toward the substrate W to bring the polishing tape 23 into contact with the substrate W, while sending the polishing tape 23. Then, the polishing head 30 oscillates laterally (i.e., in the tangential direction of the substrate W) by the above-described oscillation mechanism 70 to thereby remove the angular portion formed in the boundary portion. This third polishing step is performed without rotating the substrate W, as with the second polishing step.

In order to polish the boundary portion into a rounded shape, it is preferable to change the angle of the polishing head 30 continuously during polishing. The range of angle of the polishing head 30 is determined according to the position of the angular portion formed in the boundary portion. Generally, in the first polishing step, the angular portion is polished with the polishing head 30 tilted upward at an angle of about 45 degrees, as shown in FIG. 8. As a result, the angular portion is formed approximately in the center of the boundary portion, as shown in FIG. 16. Therefore, in this case, it is preferable to tilt the polishing head 30 continuously over a predetermined range of angle centered at zero degree.

Figure 18A:
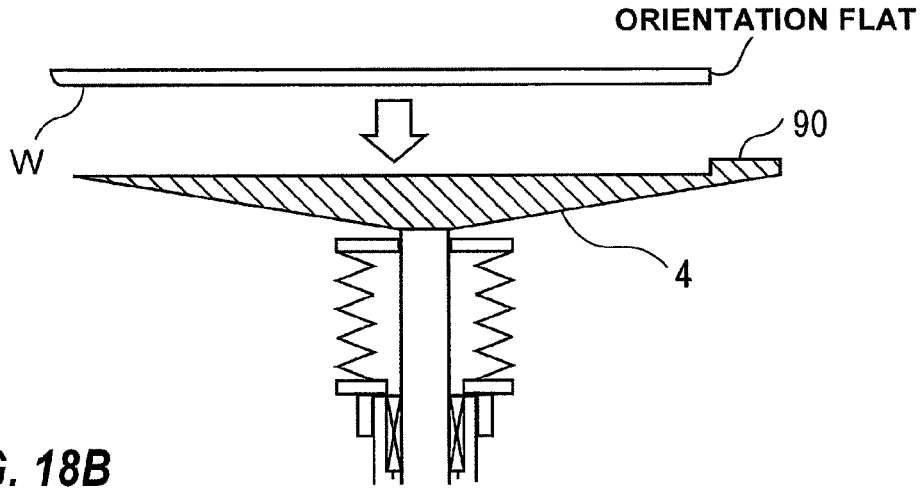
FIG. 18A and FIG. 18B are enlarged views showing a holding stage of the polishing apparatus according to another embodiment of the present invention.
Figure 18B:
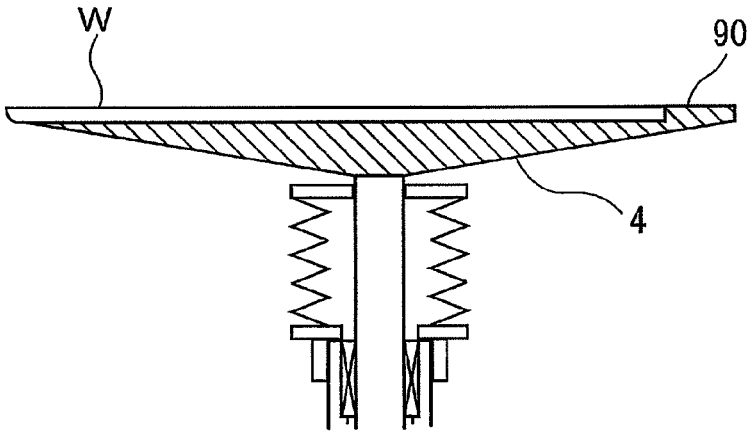

Next, another embodiment of the present invention will be described. The same structures of the polishing apparatus and the same processes of the polishing method as those of the above-described embodiment will not be described specifically. FIG. 18A and FIG. 18B are enlarged views showing the holding stage of the polishing apparatus according to another embodiment of the present invention. The polishing apparatus according to this embodiment has a cutout cover (i.e., a protection cover for protecting the orientation flat) 90 secured to the holding stage 4. This cutout cover 90 has a shape corresponding to the orientation flat. More specifically, the cutout cover 90 has a shape of bow (or crescent) that compensates for the orientation flat which is a cutout portion of the substrate W. The cutout cover 90 projects slightly from the upper surface (i.e., the substrate-holding surface) of the holding stage 4 and has substantially the same thickness as the substrate W. The cutout cover 90 is made of a material which is more unlikely to be polished than the substrate W While the cutout cover 90 is formed integrally with the holding stage 4 in this embodiment, the cutout cover may be provided as a separate part which is secured to the holding stage 4.

A length of a straight section (chord) constituting the shape of bow of the cutout cover 90 is substantially equal to a length of the orientation flat. A curvature of a curved section (an arc) constituting the shape of bow of the cutout cover 90 is substantially equal to the reciprocal of a radius of the substrate W. Therefore, the substrate W and the cutout cover 90 as viewed from above form a substantially circular shape. The orientation flat of the substrate W is detected by a detection sensor (not shown in the drawing) before the substrate W is transported into the polishing room 21, and positioning of the substrate W is performed such that the orientation flat faces in the direction of the cutout cover 90 in the polishing room 21. Thereafter, the substrate W is, as shown in FIG. 18A, carried into the polishing room 21 by the hands of the transporting mechanism (not shown in the drawing), with the orientation flat facing in the direction of the cutout cover 90. Then the substrate W is held on the upper surface of the holding stage 4 by the vacuum suction, whereby the substrate W is placed on the upper surface of the holding stage 4 with the orientation flat facing the cutout cover 90, as shown in FIG. 18B.

Figure 19:
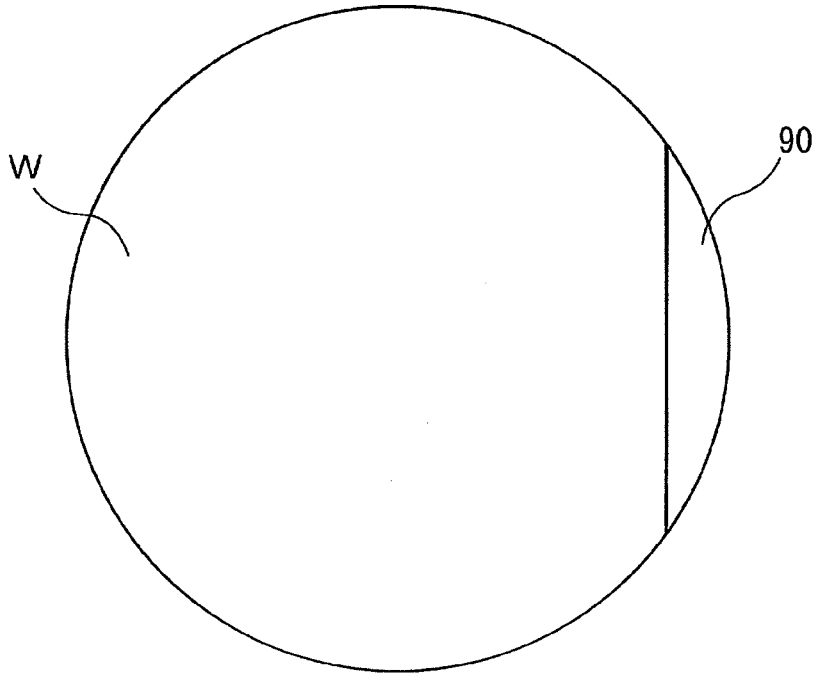
FIG. 19 is a plan view showing the substrate and a cutout cover when the substrate is held by the holding stage.

FIG. 19 is a plan view showing the substrate W and the cutout cover 90 when the substrate W is held by the holding stage 4. As shown in FIG. 19, when the orientation flat of the substrate W faces the cutout cover 90, the substrate W and the cutout cover 90 are united to form a substantially circular shape as a whole. Polishing is performed according to the method of the above-described embodiment. Specifically, the substrate W and the cutout cover 90 are rotated about the center of the substrate W by the rotary holding mechanism 3, and in this state the polishing tape 23 is pressed against the angular portion of the substrate W by the polishing head 30. This cutout cover 90 can prevent the concentration of load on the boundary portion between the orientation flat and the circumferential surface of the substrate W and can therefore prevent excessive polishing of the boundary portion.

During polishing of the angular portion of the substrate W, an outer circumferential surface of the cutout cover 90 contacts the polishing surface of the polishing tape 23. Therefore, in order to prevent the cutout cover 90 from being polished by the polishing tape 23, it is preferable to coat the outer circumferential surface of the cutout cover 90 with DLC (Diamond Like Carbon). Further, it is preferable that alumina or silica, which is a relatively soft material, be used as the abrasive particles of the polishing tape 23.

Figure 20A:
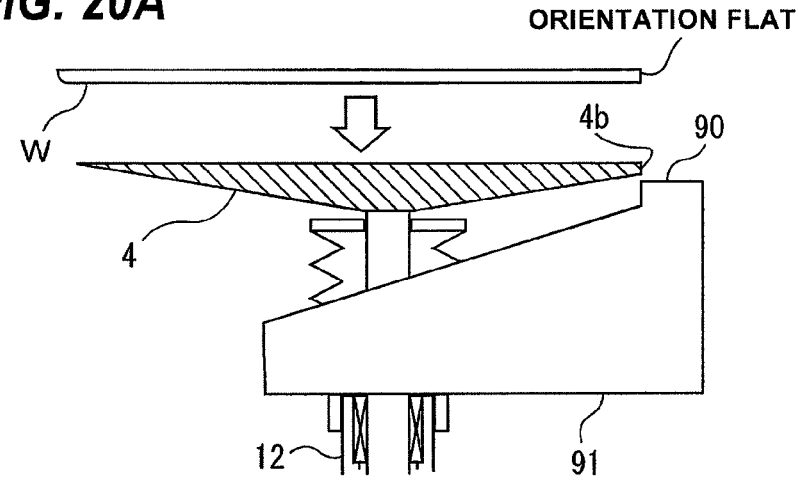
FIG. 20A through FIG. 20C are side views showing a modification example of the polishing apparatus according to the embodiment.
Figure 20B:
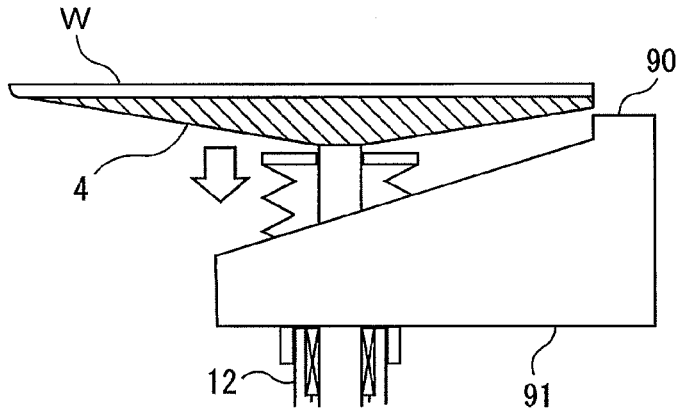
Figure 20C:
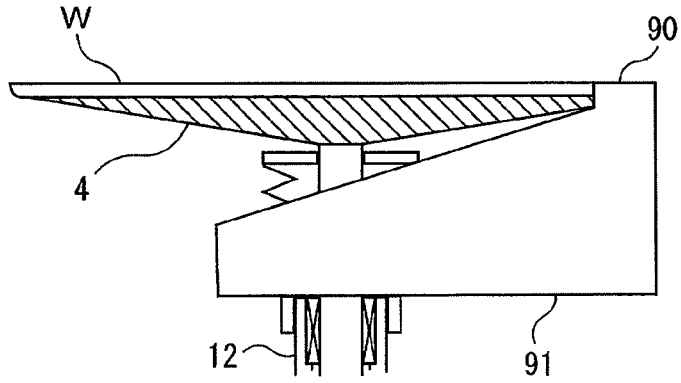

FIG. 20A through FIG. 20C are side views showing a modification example of the polishing apparatus according to the embodiment. In this modification example, the holding stage 4 has a cutout 4*b* corresponding to the orientation flat of the substrate W. Cutout cover 90 is provided as a separate part of the holding stage 4. Specifically, as shown in FIG. 20A, the cutout cover 90 is formed integrally with an upper portion of a rotary member 91. A lower end of the rotary member 91 is coupled to the upper end of the casing 12. As described previously, the casing 12 is rotated together with the holding stage 4. Therefore, the cutout cover 90 and the rotary member 91 are also rotated together with the holding stage 4. Further, since the holding stage 4 is moved vertically relative to the casing 12, the holding stage 4 is moved vertically relative to the cutout cover 90 and the rotary member 91. The shape of the cutout cover 90 as viewed from above is identical to that of the cutout cover 90 shown in FIG. 18A, FIG. 18B, and FIG. 19.

The orientation flat of the substrate W is detected by the detection sensor (not shown in the drawing) before the substrate W is transported into the polishing room 21, and positioning of the substrate W is performed such that the orientation flat faces in the direction of the cutout cover 90 in the polishing room 21. Thereafter, the substrate W is, as shown in FIG. 20A, carried into the polishing room 21 by the hands of the transporting mechanism (not shown in the drawing), with the orientation flat facing in the direction of the cutout cover 90. The substrate W is held on the upper surface of the holding stage 4 by the vacuum suction as shown in FIG. 20B. As the holding stage 4 is lowered together with the substrate W, the orientation flat and the cutout 4*b* of the holding stage 4 face the cutout cover 90, as shown in FIG. 20C.

Figure 21:
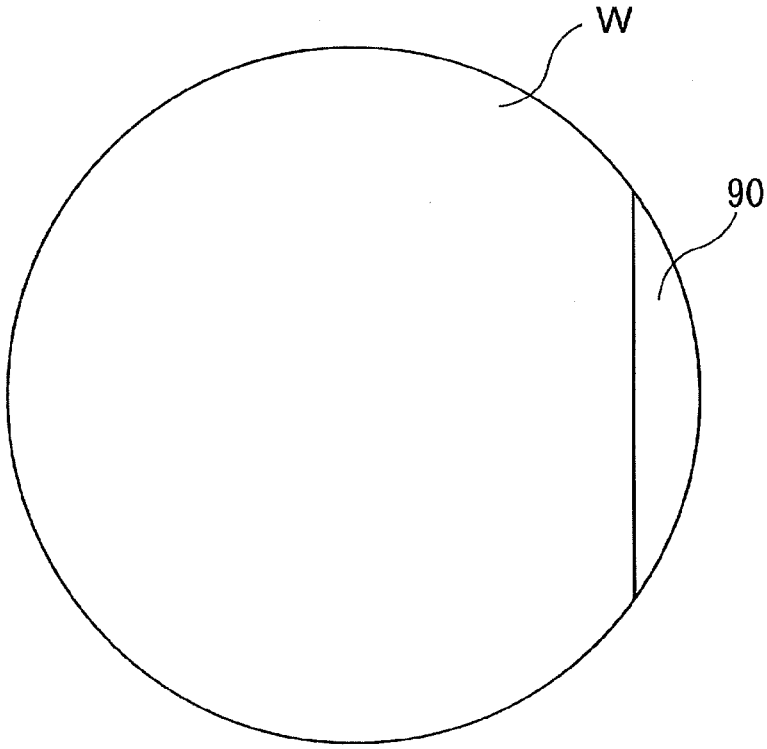
FIG. 21 is a plan view showing the substrate and the cutout cover when the substrate is held by the holding stage.

FIG. 21 is a plan view showing the substrate W and the cutout cover 90 when the substrate W is held by the holding stage 4. As shown in FIG. 21, when the orientation flat of the substrate W faces the cutout cover 90, the substrate W and the cutout cover 90 are united to form a substantially circular shape as a whole. Therefore, in this case also, the cutout cover 90 can prevent excessive polishing of the boundary portion between the orientation flat and the circumferential surface of the substrate W.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A method of polishing a substrate having a grinded back surface, said method comprising:

rotating the substrate about its center; and pressing a polishing tape against an angular portion formed by the back surface and a circumferential surface of the substrate to polish the angular portion, wherein:

a protection film is attached to a front surface and the circumferential surface of the substrate; and said pressing of the polishing tape against the angular portion to polish the angular portion is performed while peeling the protection film from the substrate by sending the polishing tape from a back-surface side to a front-surface side of the substrate.

2. A method of polishing a substrate having a grinded back surface, said method comprising:

rotating the substrate about its center; and pressing a polishing tape against an angular portion formed by the back surface and a circumferential surface of the substrate to polish the angular portion, wherein:

a protection film is attached to a front surface and the circumferential surface of the substrate; and said pressing of the polishing tape against the angular portion to polish the angular portion is performed while peeling the protection film from the substrate by continuously changing an angle of a polishing head that presses the polishing tape against the substrate.

3. A method of polishing a substrate having a grinded back surface and an orientation flat, said method comprising:

rotating the substrate about its center;

pressing a polishing tape against an angular portion formed by the back surface and a circumferential surface of the substrate to polish the angular portion;

after polishing the angular portion, rotating the substrate until the orientation flat faces the polishing tape;

polishing the orientation flat by causing the polishing tape to oscillate laterally while pressing the polishing tape against the orientation flat;

after polishing the orientation flat, rotating the substrate until a boundary portion between the orientation flat and the circumferential surface faces the polishing tape; and polishing the boundary portion by causing the polishing tape to oscillate laterally while pressing the polishing tape against the boundary portion.

4. A method of polishing a substrate having a grinded back surface and an orientation flat, said method comprising:

rotating the substrate about its center;

pressing a polishing tape against an angular portion formed by the back surface and a circumferential surface of the substrate to polish the angular portion; and causing the orientation flat to face a cutout cover having a shape corresponding to the orientation flat, wherein said polishing of the angular portion is performed while rotating the substrate and the cutout cover together about the center of the substrate.

5. The method according to claim 4, wherein during said polishing of the angular portion, the polishing tape contacts the angular portion and the cutout cover.

6. The method according to claim 4, wherein the cutout cover is configured to be unlikely to be polished.

7. The method according to claim 4, wherein the polishing tape polishes the cutout cover and the angular portion during said polishing of the angular portion.

8. An apparatus for polishing a substrate having a grinded back surface, said apparatus comprising:

a rotary holding mechanism configured to rotate the substrate about its center, said rotary holding mechanism including a cutout cover having a shape corresponding to an orientation flat of the substrate; and a polishing head configured to press a polishing tape against an angular portion formed by the back surface and a circumferential surface of the substrate so as to polish the angular portion.

9. The apparatus according to claim 8, wherein said polishing head is operable to place the polishing tape in contact with the angular portion and said cutout cover during polishing of the angular portion.

10. The apparatus according to claim 8, wherein said cutout cover is configured to be unlikely to be polished.

11. The apparatus according to claim 8, wherein the polishing tape polishes said cutout cover and the angular portion during polishing of the angular portion.

* * * * *